US008893343B2

(12) United States Patent
Libman et al.

(10) Patent No.: US 8,893,343 B2
(45) Date of Patent: Nov. 25, 2014

(54) MOP HEAD WITH CLEANING ELEMENT SECUREMENT SYSTEM AND METHOD

(75) Inventors: Robert J. Libman, Arcola, IL (US); Marco Bizzotto, Padua (IT)

(73) Assignee: The Libman Company, Arcola, IL (US)

( * ) Notice: Subject to any disclaimer, the term of this patent is extended or adjusted under 35 U.S.C. 154(b) by 251 days.

(21) Appl. No.: 13/416,620

(22) Filed: Mar. 9, 2012

(65) Prior Publication Data

US 2013/0212822 A1 Aug. 22, 2013

Related U.S. Application Data

(60) Provisional application No. 61/602,009, filed on Feb. 22, 2012.

(51) Int. Cl.
*A47L 13/258* (2006.01)

(52) U.S. Cl.
USPC ..... 15/147.2; 15/228; 15/229.6; 15/229.8

(58) Field of Classification Search
USPC ..... 15/147.2, 150, 228, 229.6, 229.8
See application file for complete search history.

(56) References Cited

U.S. PATENT DOCUMENTS

| | | | | |
|---|---|---|---|---|
| 3,737,935 | A * | 6/1973 | Saltzstein | 15/147.2 |
| D277,039 | S | 1/1985 | Miyoshi et al. | |
| D297,275 | S | 8/1988 | Cook | |
| 4,912,804 | A | 4/1990 | Pasbol | |
| 4,914,778 | A | 4/1990 | Thompson | |
| 5,253,387 | A | 10/1993 | Kresse et al. | |
| 5,361,447 | A * | 11/1994 | Ophardt | 15/229.6 |
| 5,397,622 | A | 3/1995 | Thomas | |
| 5,398,492 | A | 3/1995 | Thomas | |
| 5,442,830 | A | 8/1995 | Ohm | |
| 5,452,491 | A | 9/1995 | Thompson | |
| 5,864,914 | A | 2/1999 | Salmon | |
| 6,260,226 | B1 | 7/2001 | Specht | |
| 6,487,745 | B2 | 12/2002 | Specht | |
| 7,039,969 | B2 | 5/2006 | Zorzo | |
| D549,414 | S | 8/2007 | Van Landingham, Jr. | |
| D586,513 | S | 2/2009 | PZW Pho | |
| 7,496,985 | B1 * | 3/2009 | Morad | 15/228 |
| D597,718 | S | 8/2009 | McNeil et al. | |
| D625,480 | S | 10/2010 | Raven | |
| 8,356,379 | B2 * | 1/2013 | Fischer | 15/147.2 |

OTHER PUBLICATIONS

UltraMax Flat Mop, Vileda, www.vileda.ca/en/mops/flat/ultramax.aspx, retrieved from internet Apr. 27, 2012.

(Continued)

*Primary Examiner* — Randall Chin
(74) *Attorney, Agent, or Firm* — Banner & Witcoff, Ltd.

(57) ABSTRACT

A mop head which provides for both the reliable securement of a cleaning element to the mop head and for simple and efficient installation and removal of the cleaning element from the mop head is presented. The mop head includes a first securement member and a second securement member adapted for securing a cleaning element to the mop head, wherein the first securement member is pivotally connected to the second securement member at a pivot joint. The securement members are movable about the pivot joint into a use position and change position. The cleaning element can be mated to the securement members in the change position and movement of the securement members to use position secures cleaning element to the mop head for use. A latch locks the securement members in the use position to prevent movement of the securement members about the pivot joint.

17 Claims, 7 Drawing Sheets

(56) References Cited

OTHER PUBLICATIONS

Fibro Contact Flat Mop, Vileda, www.vileda.ca/en/mops/flat retrieved from internet Apr. 27, 2012.
ProMist Flat Mop, Vileda, www.vileda.ca/en/mops/flat/promist.aspx, retrieved from internet Apr. 27, 2012.
Ultramax Plus Flat Mop, Vileda, www.vileda.ca/en/mops/flat/ultramax-plus.aspx, retrieved from internet Apr. 27, 2012.
Profi Floor Mop with Micro Duo Pad, www.leifheitus.com/Profi-Floor-Mop-With-Micro-Duo-Pad-plus55049.html, retrieved from internet Apr. 30, 2012.

* cited by examiner

MOP HEAD WITH CLEANING ELEMENT SECUREMENT SYSTEM AND METHOD

CROSS-REFERENCE TO RELATED APPLICATIONS

This application claims priority to U.S. Provisional Application Ser. No. 61/602,009, filed on Feb. 22, 2012, which is incorporated by reference in its entirety as if fully set forth herein. This application is related to U.S. patent application Ser. Nos. 29/413,941 and 29/413,942, which were filed Feb. 22, 2012 and entitled "Mop Head Securement System," which are incorporated by reference in their entirety as if fully set forth herein.

BACKGROUND

Mops are widely used for washing floors, windows, and walls. In general, a mop includes a handle, mop head, and a cleaning element, such as a bundle of textile strands, a cloth, or sponge. Mops utilize various systems and methods to secure the cleaning element to the mop head. The cleaning element is generally removable when dirty and/or damaged so that a clean or replacement cleaning element can be installed and the mop reused.

It is desirable to provide for the replacement of the cleaning element of a mop in a simple and efficient manner. It is also desirable that the cleaning element be well secured to the mop head so that the cleaning element can maintain engagement with the mop head and withstand the force applied to the cleaning element during use. Accordingly, it is desirable that the cleaning element be both simple and efficient to replace and be secured in a durable manner to the mop head.

Various attempts have been made to provide for both ease of replacement and durable securement of the cleaning element to the mop head, but have resulted in limited success. Systems which provide for simple and efficient replacement of the cleaning element can compromise the strength of securement of the cleaning element to mop head and vice versa. Therefore, there exists a need for a robust yet simple methodology to provide for ease of replacement and durable securement of the cleaning element to the mop head.

SUMMARY

In light of the foregoing background, the following presents a simplified summary of the present disclosure in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

Aspects of the present disclosure are directed to a mop head with securement members pivotally connected at pivot joint and movable about the pivot joint into a change position and a use position. A cleaning element may be mated with the securement members in the change position and then secured to the mop head by positioning the securement members into the use position.

Other aspects of the present disclosure are directed to a latch for locking the securement members into the use position so as to resist movement of the securement members about the pivot joint during use of the mop head. Other aspects of the latch include a lever arrangement that both disengages the latch and moves the securement members from the use position into the change position.

Aspects of the present disclosure relate to an apparatus comprising: a mop head comprising a first securement member and a second securement member adapted for securing a cleaning element to the mop head, wherein the first securement member is pivotally connected to the second securement member at a pivot joint, the first securement member having a first distal end located distally from the pivot joint and the second securement member having a second distal end located distally from the pivot joint; a latch connected to the first securement member; a locking member connected to the second securement member; wherein the first securement member and the second securement member are moveable by pivoting about the pivot joint between a change position and a use position; wherein a first distal end of the first securement member is positioned at a first distance from the second distal end of the second securement member when the first and second securement members are in the change position so that the first and second securement members are adapted to allow installation and removal of the cleaning element in the change position, and the first distal end is positioned at a second distance from the second distal end when the securement members are in the use position so that the securement members are adapted to secure the cleaning element to the mop head in the use position; wherein the first distance is less than the second distance; wherein the latch engages the locking member when the first securement member and second member are in the use position to resist pivoting of the first and second securement members and to lock the first and second securement members in the use position; and a handle coupler connected to the mop head and adapted for connecting a handle to the mop head.

A method of securing a cleaning element to a mop head comprising: positioning a first securement member and a second securement member of a mop head in a change position, the first securement member is pivotally connected to the second securement member at a pivot joint and are moveable about the pivot joint so as to allow installation of the cleaning element on the distal ends of the securement members while in the change position; installing the cleaning element on the first and second securement members; positioning the first and second securement members in a use position by pivoting the first and second securement members about the pivot joint; and securing the cleaning element to the mop head by locking the first and second securement members in the use position to resist pivoting of the first and second securement members.

BRIEF DESCRIPTION OF THE DRAWINGS

A more complete understanding of aspects of the present disclosure and the advantages thereof may be acquired by referring to the following description in consideration of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the disclosure may be practiced. It is to be understood that other embodiments may be utilized and structural and functional modifications may be made.

Figure 1:
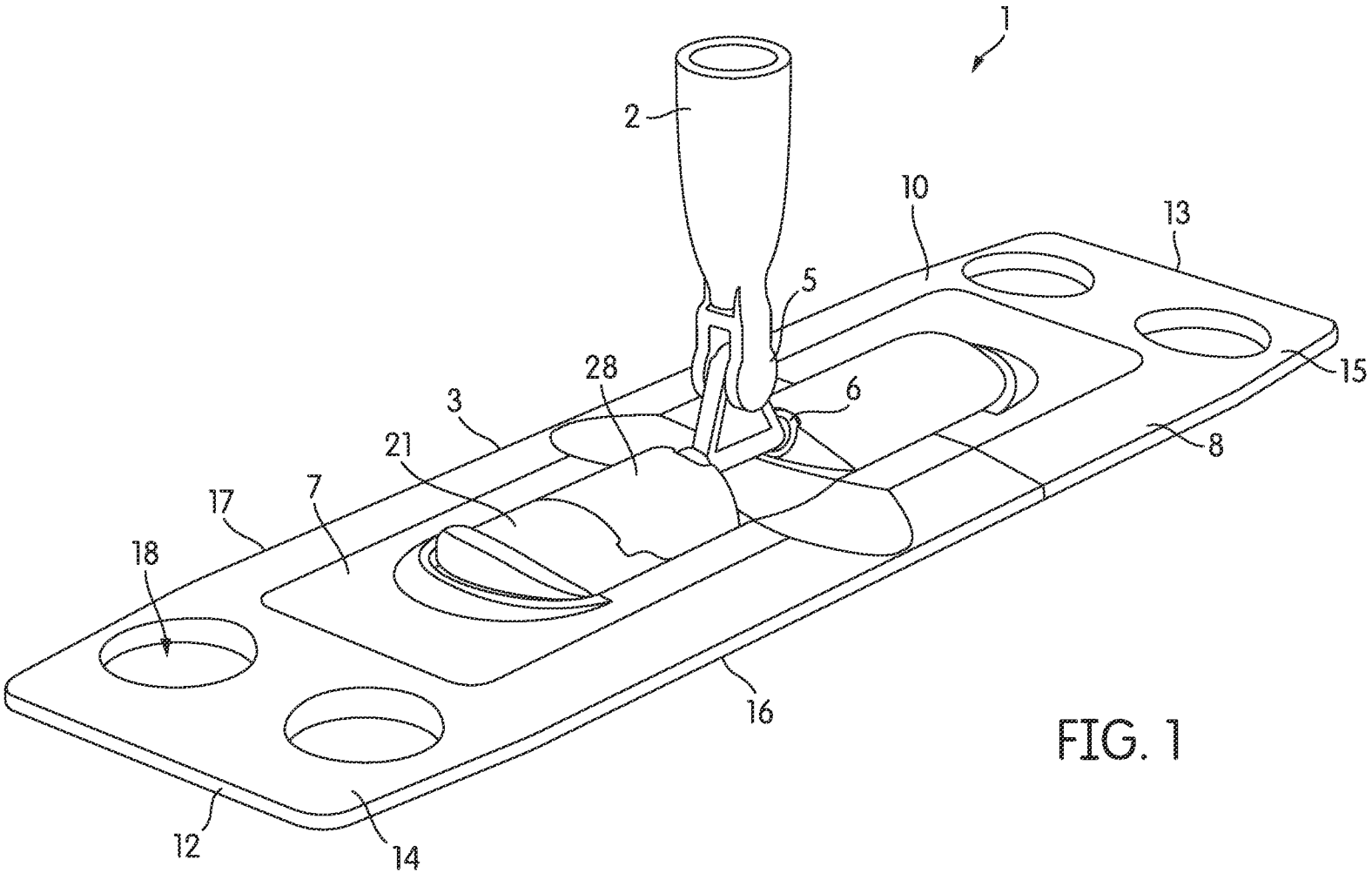
FIG. 1 shows a top perspective view of a mop head in accordance with certain aspects of the present disclosure.

FIG. 1 shows a top perspective view of a mop head in accordance with certain aspects of the present disclosure. The mop head 1 includes a handle coupler 2 and a securement member 3. The handle coupler 2 is connected to the securement member 3. In one embodiment, a cleaning element 4 can be secured to the securement member 3, such as for example, in a manner described below. A handle (not shown) can be connected to the handle coupler 2 by, for example, adhesive or by screw thread, where external threads on the handle mate with internal threads defined in the handle coupler 2. The handle coupler 2 can be connected to the securement member 3 by, for example, a pair of consecutively positioned swivel joints. The swivel joints can be oriented transverse to each other such that a first swivel joint 5 can allow for movement of the handle to the sides of the mop head 1 and a second swivel joint 6 can allow for movement of the handle to the front and rear of the mop head 1. In one embodiment, the handle coupler is configured, such as with using the pair of swivel joints described above and shown in FIGS. 1 and 4-7, to allow the handle to be positioned substantially parallel to the underside surface of the mop head. This allows the underside of the mop head to be in contact with the floor while the handle is positioned substantially parallel to the floor. This feature provides advantages such as ease of manipulating the mop head and reaching under structures, such as furniture, during cleaning.

Figure 2:
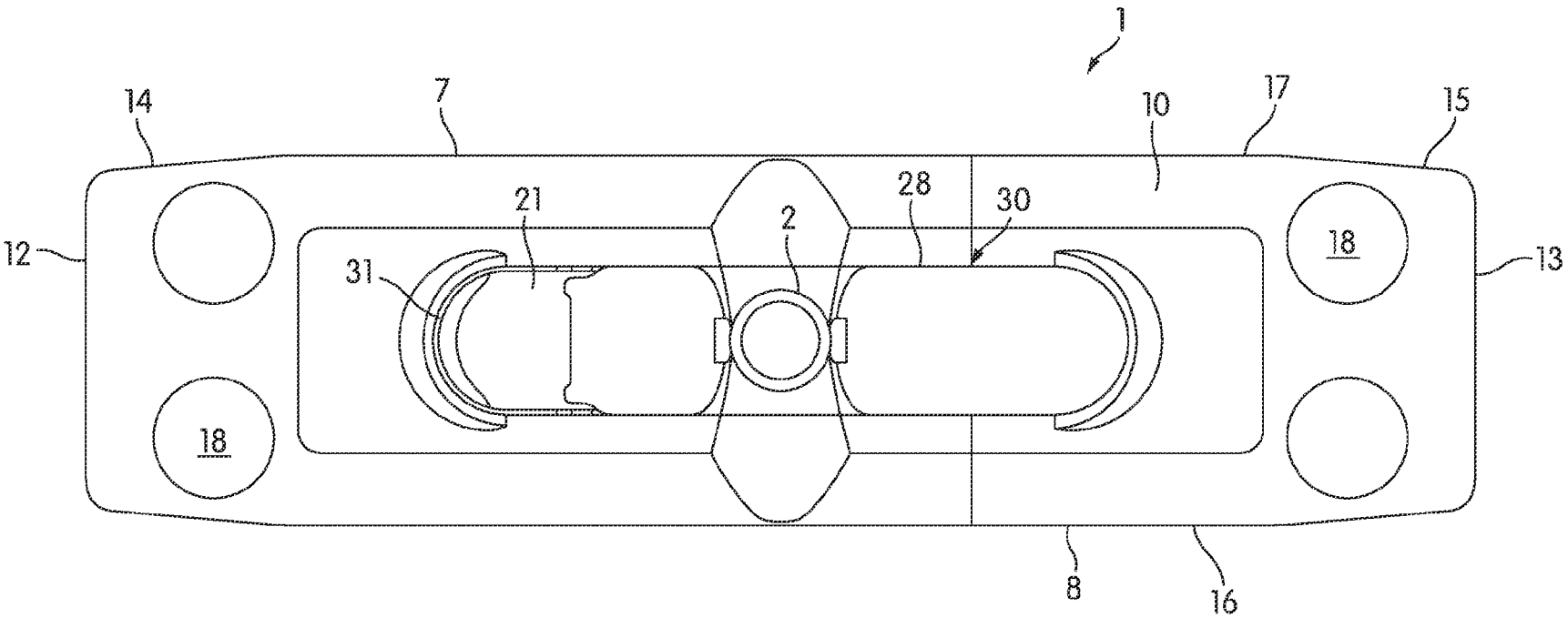
FIG. 2 shows a top view of a mop head in accordance with certain aspects of the present disclosure.
Figure 3:
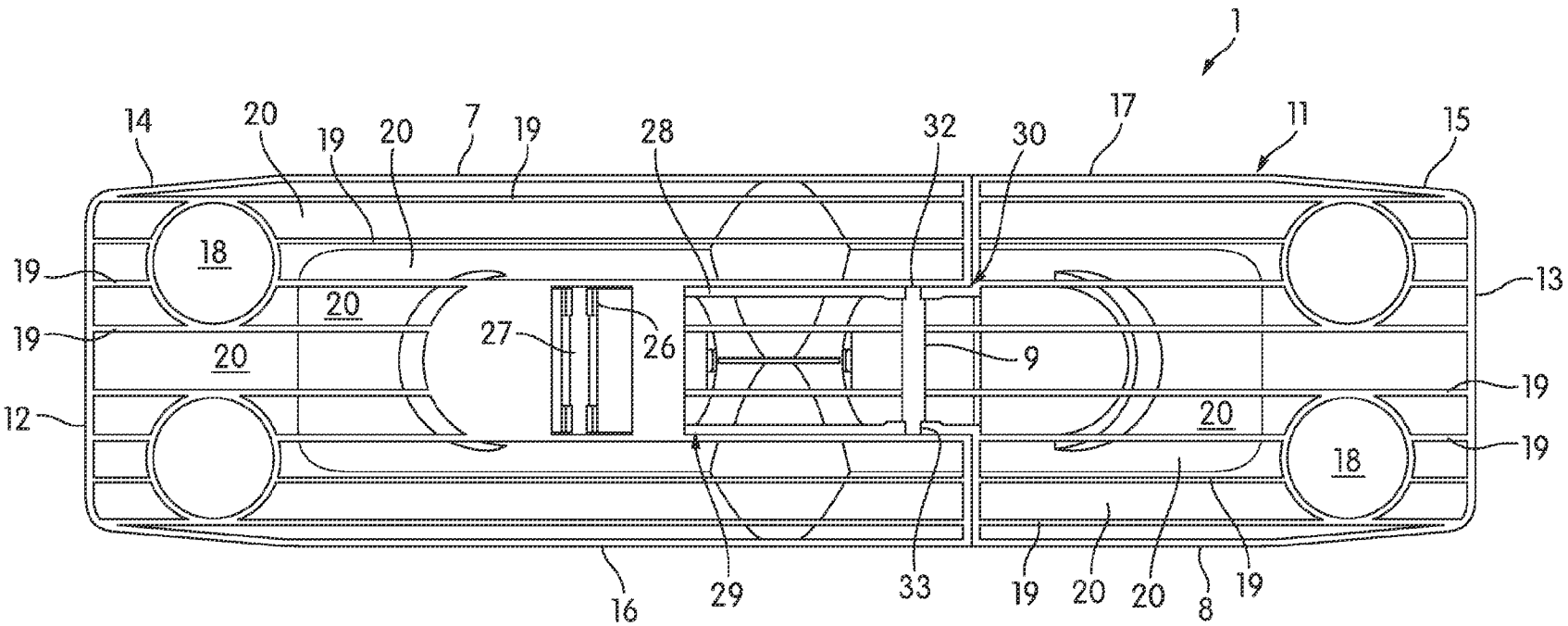
FIG. 3 shows a bottom view of a mop head with certain aspects of the present disclosure.
Figure 4:
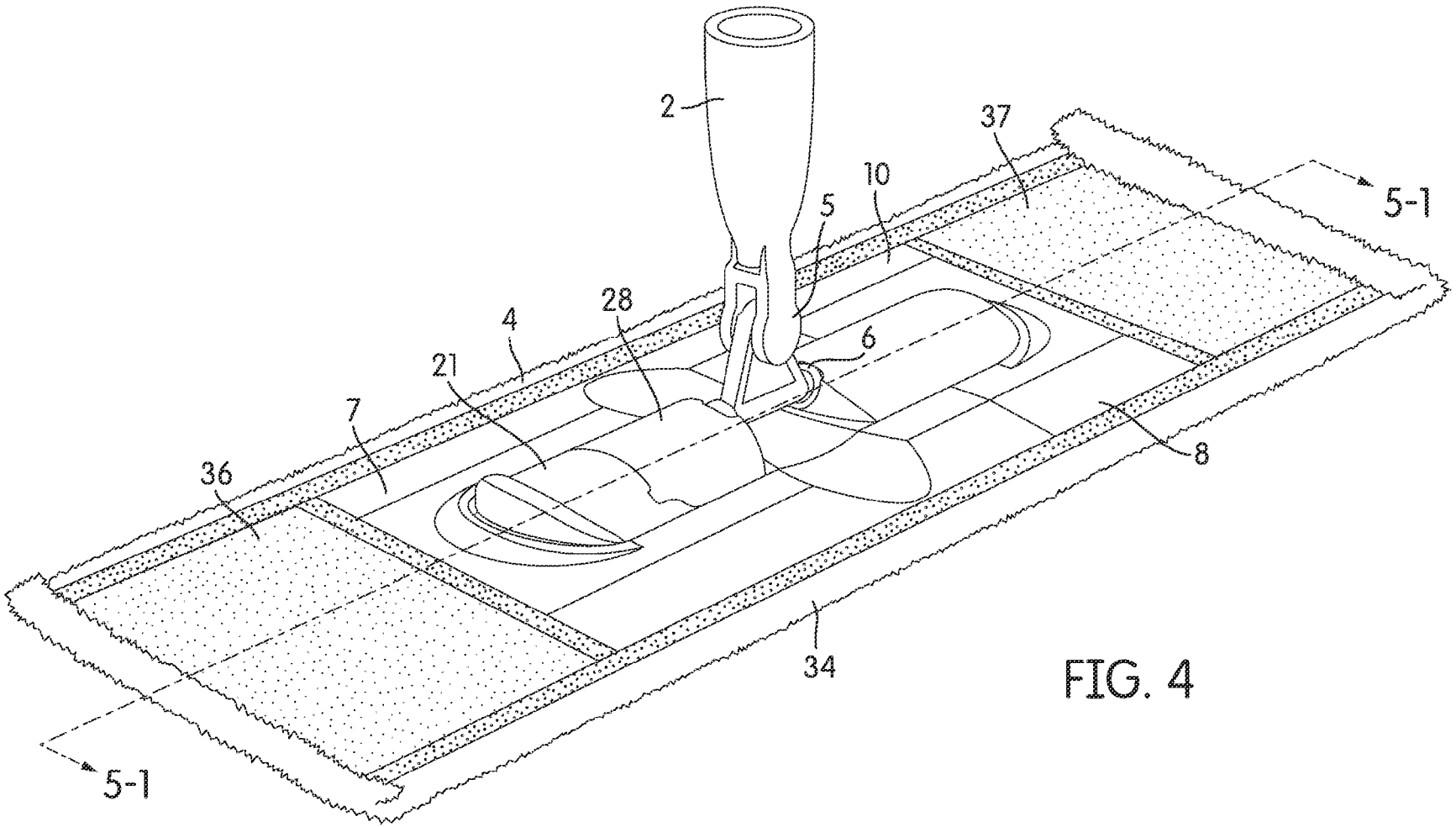
FIG. 4 shows a top perspective view of a mop head with cleaning element secured thereon in accordance with certain aspects of the present disclosure.

Referring to FIGS. 1 through 7 the securement member can include a first securement member 7 and a second securement member 8. In one embodiment, the first and second securement members can be configured and positioned relative to each other to form a generally rectangular plate having a top side 10, and underside 11, a first distal end 14 having a first distal edge 12, and a second distal end 15 having a second distal edge 13. As shown in the FIGS. 1-3, the first and second distal ends 14, 15 can be configured so that the first and second distal edges 12, 13 are opposite each other, substantially parallel, and of substantially equal length. The term substantially parallel as used herein refers to a tolerance of about plus or minus 25° from an exact parallel orientation. The term substantially equal length as used herein refers to a tolerance of about plus or minus 25% in length. The plate configuration can further include a first and second peripheral edge 16, 17 extending between the first and second distal edges 12, 13. As shown in FIGS. 1-3, the first and second peripheral edges 16, 17 can be configured so that they are opposite each other, substantially parallel, and of substantially equal length. Also as shown in FIGS. 1-3, the peripheral edges 16, 17 extend longitudinally between the distal edges 12, 13. Also, the distal edges 12, 13 extend latitudinally between the peripheral edges 16, 17. In addition, the peripheral edges 16, 17 can be greater in length than the distal edges 12, 13. Length in latitudinal direction can also be referred to herein as latitudinal width.

Referring to FIG. 2, in one embodiment, a portion of the latitudinal width between the peripheral edges 16, 17 at the distal ends 14, 15 taper toward the distal edges 12, 13. Also, in one embodiment, a plurality of holes 18 can be defined in the distal ends 14, 15. Referring to FIG. 3, in one embodiment, a plurality of longitudinal strips 19 define a plurality of longitudinal channels 20 in the underside 11 of the securement members 7, 8.

In one embodiment, the first securement member 7 is pivotally connected to the second securement member 8 at a pivot joint 9. The pivot joint 9 can be located in between the distal ends 14, 15, such that the distal ends are located distally from the pivot joint 9, such as for example as shown in FIGS. 3 and 5-7. This permits the first securement member 7 and second securement member 8 to be moved and positioned by pivoting about the pivot joint 9.

Figure 5:
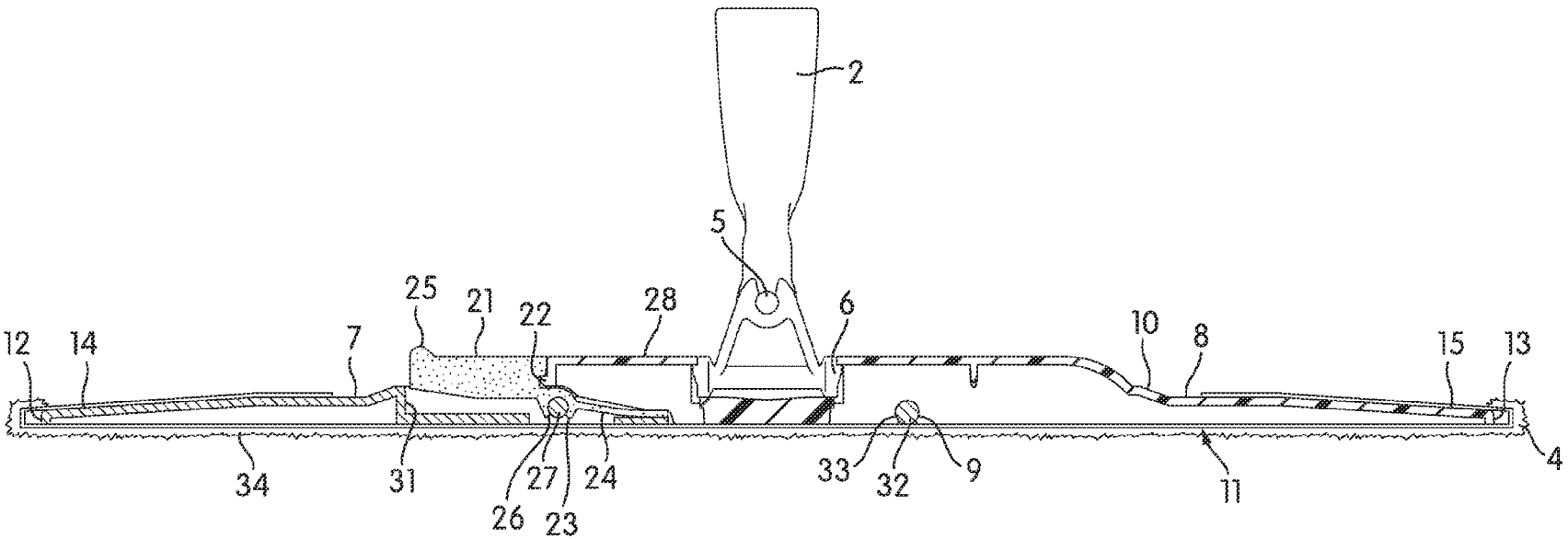
FIG. 5 shows a front, cross-sectional view of a mop head, taken along line 5-1 of FIG. 4, in accordance with certain aspects of the present disclosure.
Figure 7:
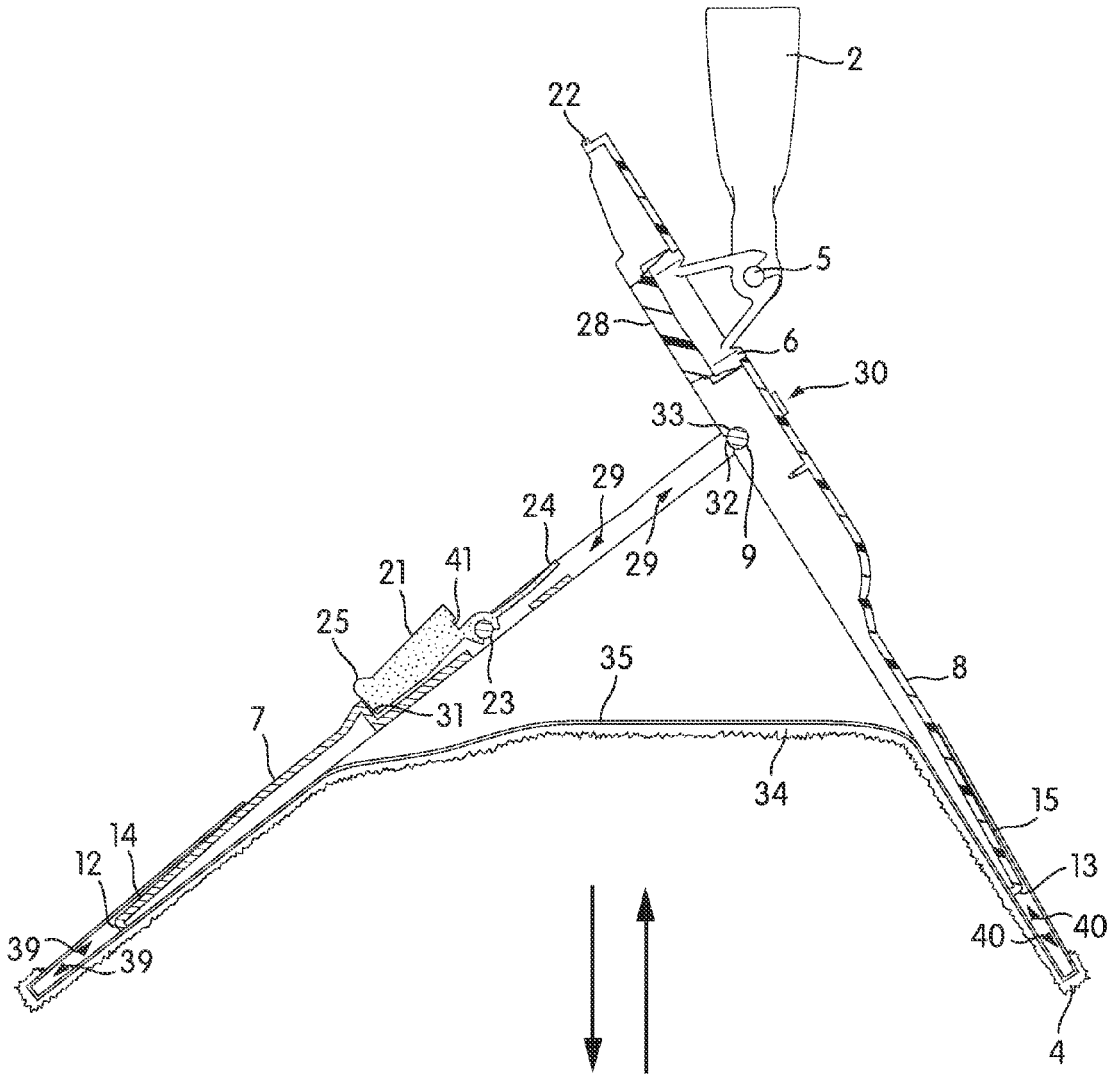
FIG. 7 shows a front, cross-sectional view of the mop head of FIG. 5 in accordance with certain aspects of the present disclosure.

In one embodiment, the securement members 7, 8 are adapted to allow for both the reliable securement of a cleaning element 4 to the mop head 1 and for simple and efficient installation and removal of the cleaning element 4 from the mop head 1 by pivoting about the pivot joint 9. For example, the securement members 7, 8 can be positioned between a change position and a use position by moving about the pivot joint 9. An example use position is shown in FIG. 5 and an example change position is shown in FIG. 7. In the example shown in FIG. 7, the securement members 7, 8 are positioned in the change position such that the distance between distal ends 14, 15 is less than it would be if the securement members 7, 8 were in the use position. The distance between the distal ends 14, 15 in the change position can be referred to as the first distance while the distance between the distal ends 14, 15 in the use position can be referred to as the second distance. The distance between the distal edges 12, 13 in the change and use can also be referred to as the first and second distance as used herein, respectively. When the securement members 7, 8 are in the change position, a cleaning element of, for example, substantially equal length to the longitudinal peripheral edges 16, 17 can be easily and quickly installed or removed from the securement members. When a cleaning element 4 is installed on the securement members 7, 8 while in the change position, by for example mating distal ends of the cleaning element with distal ends of the securement members, and the securement members are then positioned in the use position, the securement members can secure the cleaning element to the mop head by spanning the cleaning element taut across the bottom of the mop head 1, as shown, for example, in FIGS. 4 and 5.

Figure 6:
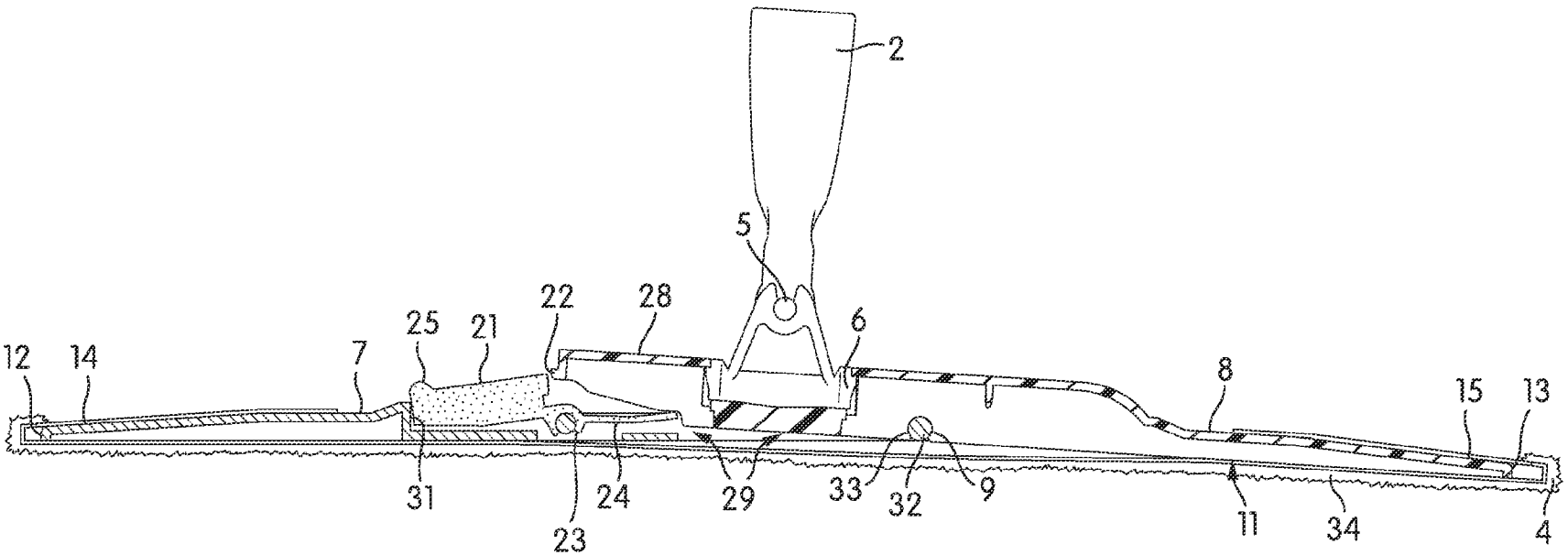
FIG. 6 shows a front, cross-sectional view of the mop head of FIG. 5 in accordance with certain aspects of the present disclosure.

In one embodiment, a latch 21 is used to lock the securement members 7, 8 in the use position. Referring to FIGS. 5-7, the latch 21 can be connected to the first securement member 7 and a locking member 22 for engaging the latch 21 can be connected to the second securement member 8. In one embodiment, the latch 21 can include a locking member receiver 41 in the form of a groove 41 defined in the engagement point of the latch and the locking member 22 can be a tab 22 having a configuration complimentary with the groove 41. When engaged, the latch 21 and locking member 22 resist pivoting of the first and second securement members 7, 8 and lock the securement members 7, 8 in the use position.

In one embodiment, the latch 21 is in the form of a lever and facilitates disengagement of the latch 21 from the second securement member 8 and moves the second securement member 8 toward the change position. For example, referring to FIGS. 5-7, the latch 21 can be pivotally connected to the first securement member 7 at a latch pivot joint 23. The latch 21 can include a load arm 24 and an effort arm 25 extending from opposite sides of the latch pivot joint 23 to form a lever arrangement. In the use position, the load arm 24 is in contact with the second securement member 8 at, for example, one or more of the longitudinal strips 19 in the underside 11. When adequate downward pressure is applied to the effort arm 25, the latch 21 disengages from the locking member 22 and the load arm 24 moves the second securement member 8 toward the change position, such as, for example, as shown in FIG. 6. In one embodiment the latch 21 is made of resilient plastic. Use of a resilient plastic can obviate the option of using a resistance element, such as spring, in conjunction with the latch. In addition, each component of the mop head can be made of plastic and/or other suitable materials used in the art.

In one embodiment, the latch pivot joint 23 includes a first latch pivot connector 26 on the latch 21 and a second latch pivot connector 27 on the first securement member 7. the first and second latch pivot connectors 26, 27 engage each other to form the latch pivot joint 23. As shown in the example embodiments of FIGS. 3 and 5-7, the first latch pivot connector 26 can be a latch pivot post 26 and the second latch pivot connector 27 can be a receiver, such as a saddle receiver 27, that receives the latch pivot post 26 and allows for the latch 21 to pivot about the latch pivot joint 23.

In one embodiment, the second securement member 8 includes a longitudinal tongue element 28 extending in the direction opposite to the second distal end 15 and the first securement member 7 includes a longitudinal slot 29 in which the tongue 28 fits when the securement members 7, 8 are positioned in the use position. The slot 29 is defined in the first securement member 7 and has an open end 30 opposite the first distal end 14 and a closed end 31 located in between the open end 30 and the distal end 14. Referring to FIGS. 4-7, in one example embodiment, the locking member 22 is connected to an end of the tongue 28.

In one embodiment, the pivot joint 9 connecting the first and second securement members 7, 8 is positioned within the slot 29. For example, referring to FIGS. 3 and 5-7, the pivot joint can include a first pivot joint connector 32 and a second pivot joint connector 33. The first pivot joint connector 32 can be connected to the first securement member 7 and be, for example, in the form of a post 32 positioned latitudinally in the slot 29 proximate the open end 30. The second pivot joint connector 33 can be a receiver defined in the tongue 28 of the second securement member 8 and be, for example, in the form of a saddle receiver 33. The latch pivot joint 23 can be located in the slot 29 proximate to the closed end 31.

Referring to FIGS. 4-7, a mop head in accordance with certain aspects of the disclosure above can secure a cleaning element in a reliable manner and provide for simple and efficient installation and removal of the cleaning element. In one embodiment, the cleaning element 4 includes a cleaning surface 34 for cleaning soiled surfaces. The cleaning surface can be comprised of cleaning materials such as, for example, textiles, sponge, microfibers, and other materials utilized in the art for cleaning soiled or wet surfaces. The cleaning element 4 further includes a mating surface 35 for mating with the underside 11 and/or bottom surface of the mop head 1. In one embodiment, the cleaning element 4 includes a first mating element 36 and a second mating element 37. The first and second mating elements can be in the form of a first and second pocket 36, 37 connected to the mating surface 35 of the cleaning element 4 on opposite distal edges of the cleaning element. The first and second pockets 37, 38 can define a first and second pocket cavity 39, 40. The mating elements 36, 37 can be mated to the distal ends 14, 15 of the securement members 7, 8 by, for example, while in the change position, inserting the first distal end 14 into the first pocket cavity 39 and inserting the second distal end 15 into the second pocket cavity 40. The cleaning element 4 can then be secured to the mop head 1 by moving the securement members from the change position into the use position and engaging the latch 21. The cleaning element 4 can be removed from the mop head 1 by disengaging the latch 21, moving the securement members 7, 8 into the change position, and sliding the pockets 37, 38 off of the distal ends 14, 15. The reference arrows shown in FIG. 7 refer to the cleaning element 4 being adapted to be installed or removed while in the change position.

While the terms "first," "second," "top," "bottom," "front," "back," "underside," "side," "rear," and the like may be used in this specification to describe various example features and elements of the invention, these terms are used herein as a matter of convenience and for reference purposes only, e.g., based on the example orientations shown in the figures or the orientation during typical use, and should not otherwise be considered limiting. Additionally, the term "plurality," as used herein, indicates any number greater than one, either disjunctively or conjunctively, as necessary, up to an infinite number.

While illustrative apparatuses and methods as described herein embodying various aspects of the present disclosure are shown, it will be understood by those skilled in the art, that the disclosure is not limited to these embodiments. Modifications may be made by those skilled in the art, particularly in light of the foregoing teachings. For example, each of the elements of the aforementioned embodiments may be utilized alone or in combination or subcombination with elements of the other embodiments. It will also be appreciated and understood that modifications may be made without departing from the true spirit and scope of the present disclosure. The description is thus to be regarded as illustrative instead of restrictive on the present disclosure.

What is claimed is:

1. An apparatus comprising:

a mop head comprising a first securement member and a second securement member adapted for securing a cleaning element to the mop head, wherein the first securement member is pivotally connected to the second securement member at a pivot joint, the first securement member having a first distal end located distally from the pivot joint and the second securement member having a second distal end located distally from the pivot joint;

a latch connected to the first securement member;

a locking member connected to the second securement member;

wherein the latch includes a locking member receiver defined in an engagement point of the latch and wherein the locking member includes a tab having a configuration complimentary with the locking member receiver;

wherein the first securement member and second securement member are moveable by pivoting about the pivot joint between a change position and a use position;

wherein a first distal end of the first securement member is positioned at a first distance from the second distal end of the second securement member when the first and second securement members are in the change position so that the first and second securement members are adapted to allow installation and removal of the cleaning element in the change position, and the first distal end is positioned at a second distance from the second distal end when the securement members are in the use position so that the securement members are adapted to secure the cleaning element to the mop head in the use position;

wherein the first distance is less than the second distance;

wherein the locking member receiver of the latch engages the tab of the locking member when the first securement member and second member are in the use position to resist pivoting of the first and second securement members and to lock the first and second securement members in the use position; and a handle coupler connected to the mop head and adapted for connecting a handle to the mop head.

2. The apparatus of claim 1, further comprising the cleaning element, wherein the cleaning element comprises a cleaning surface adapted to clean a soiled surface and a mating surface opposite the cleaning surface which is adapted to mate with the first and second securement members.

3. The apparatus of claim 2, wherein the cleaning element further comprises a first mating element adapted for mating with the first securement member and a second mating element adapted for mating with the second securement member.

4. The apparatus of claim 3, wherein the first mating element comprises a first pocket connected to the mating surface of the cleaning element which defines a first pocket cavity;

wherein the second mating element comprises a second pocket connected to the mating surface of the cleaning element which defines a second pocket cavity;

wherein the first pocket is adapted to mate with the first securement member by inserting the first distal end into the first pocket cavity; and wherein the second pocket is adapted to mate with the second securement member by inserting the second distal end into the second pocket cavity.

5. The apparatus of claim 1, wherein the latch is pivotally connected to the first securement member at a latch pivot joint, the latch having a load arm and an effort arm extending from opposite sides of the latch pivot joint to form a lever arrangement, wherein the load arm is in contact with the second securement member when the securement members are in the use position; and wherein the latch is adapted such that downward pressure applied to the effort arm disengages the latch from the locking member and causes the load arm to move the second securement member toward the change position.

6. The apparatus of claim 5, wherein the latch pivot joint includes a first latch pivot connector on the latch and a second latch pivot connector on the first securement member, such that the first and second latch pivot connectors engage each other to form the latch pivot joint, wherein the first pivot connector is a latch pivot post and the second pivot connector is a latch pivot receiver that receives the latch pivot post.

7. The apparatus of claim 1, wherein, in the use position, the first securement member and the second securement member form a generally rectangular plate having a top side, an underside, a first distal edge on the first distal end, a second distal edge on the second distal end, a first longitudinal peripheral edge extending between the first and second distal edges, and a second longitudinal peripheral edge extending between the first and second distal edges and opposite the first longitudinal peripheral edge, wherein the first and second longitudinal peripheral edges are of substantially equal length, and the first and second distal edges are of substantially equal length, and the first and second longitudinal peripheral edges are greater in length than the first and second distal edges.

8. The apparatus of claim 7, wherein a plurality of longitudinal strips define a plurality of longitudinal channels in the underside.

9. The apparatus of claim 7, wherein a portion of the width between the first and second peripheral edges at the first and second distal ends taper toward the first and second distal edges.

10. The apparatus of claim 7, wherein the second securement member has a longitudinal tongue element opposite the second distal end and the first securement member has a longitudinal slot defined in a portion of the first securement member opposite the first distal end, the longitudinal slot having an open end opposite the first distal end and a closed end located in between the open end and the first distal end;

wherein the locking member is connected to an end of the tongue opposite the second distal end;

wherein the tongue fits within the slot and the locking member engages the latch when the first and second securement members are in the use position.

11. The apparatus of claim 10, wherein the pivot joint comprises a post and a saddle, wherein the post is positioned latitudinal in the slot of the first securement member proximate the open end and a saddle is defined in the tongue of the second securement member.

12. The apparatus of claim 11, wherein the latch is pivotally connected to the first securement member at a latch pivot joint, the latch pivot joint having a first latch pivot connector on the latch and a second latch pivot connector on the first securement member located in the slot proximate the closed end of the slot, such that the first and second latch pivot connectors engage each other to form the latch pivot joint;

the latch having a load arm and an effort arm extending from opposite sides of the pivot joint to form a lever arrangement, wherein the load arm is in contact with the second securement member when the securement members are in the use position; and wherein the latch is adapted such that downward pressure applied to the effort arm disengages the latch from the locking member and causes the load arm to move the second securement member toward the change position.

13. An apparatus comprising:

a mop head comprising a first securement member and a second securement member adapted for securing a cleaning element to the mop head, wherein the first securement member is pivotally connected to the second securement member at a pivot joint, the first securement member having a first distal end located distally from the pivot joint and the second securement member having a second distal end located distally from the pivot joint;

wherein the first securement member and second securement member are moveable by pivoting about the pivot joint between a change position and a use position;

wherein a first distal end of the first securement member is positioned at a first distance from the second distal end of the second securement member when the first and second securement members are in the change position so that the first and second securement members are adapted to allow installation and removal of the cleaning element in the change position, and the first distal end is positioned at a second distance from the second distal end when the securement members are in the use position so that the securement members are adapted to secure the cleaning element to the mop head in the use position;

wherein the first distance is less than the second distance;

wherein the cleaning element comprises a cleaning surface adapted to clean a soiled surface and a mating surface opposite the cleaning surface which is adapted to be secured to the securement members;

a latch connected to the first securement member;

a locking member connected to the second securement member;

wherein the latch includes a locking member receiver defined in an engagement point of the latch and wherein the locking member includes a tab having a configuration complimentary with the locking member receiver;

wherein the locking member receiver of the latch engages the tab of the locking member when the first securement member and second member are in the use position to resist pivoting of the first and second securement members and to lock the first and second securement members in the use position; and a handle coupler connected to the mop head and adapted for connecting a handle to the mop head.

14. A method of securing a cleaning element to a mop head comprising:

positioning a first securement member and a second securement member of a mop head in a change position, wherein the first securement member is pivotally connected to the second securement member at a pivot joint, the first securement member having a first distal end located distally from the pivot joint and the second securement member having a second distal end located distally from the pivot joint, wherein the first securement member and second securement member are moveable to the change position by pivoting about the pivot joint so that the first distal end is positioned at a first distance from the second distal end to allow installation of the cleaning element;

installing the cleaning element on the first and second securement members, wherein the cleaning element comprises a cleaning surface and a mating surface opposite the cleaning surface which is adapted to mate with to the first and second securement members;

positioning the first and second securement members in a use position by pivoting the first and second securement members about the pivot joint so that the first distal end is positioned at a second distance from the second distal end; and securing the cleaning element to the mop head by locking the first and second securement members in the use position to resist pivoting of the first and second securement members;

wherein the locking of the first and second securement members in the use position further comprises engaging a latch and a locking member, wherein the latch is connected to the first member and a locking member is connected to the second securement member, wherein the latch engages the locking member by receiving a tab of the locking member in a locking member receiver defined in the latch;

wherein the latch is pivotally connected to the first securement member at a latch pivot joint, the latch having a load arm and an effort arm extending from opposite sides of the latch pivot joint to form a lever arrangement, wherein the load arm is in contact with the second securement member when the securement members are in the use position; and wherein the latch is adapted such that downward pressure applied to the effort arm disengages the latch from the locking member and causes the load arm to move the second securement member toward the change position.

15. The method of claim 1, further comprising disengaging the latch from the locking member and moving the first and second securement members from the use position toward the change position, wherein the disengaging the latch and the moving the first and second securement members from the use position toward the change position is performed by applying downward pressure to the effort arm of the latch.

16. The method of claim 14, wherein installing the cleaning element further comprises mating a first mating element with the first distal end and mating a second mating element with the second distal end.

17. The method of claim 16, wherein the first mating element comprises a first pocket connected to the mating surface of the cleaning element which defines a first pocket cavity, and mating the first mating element with the first distal end by inserting the first distal end into the first pocket cavity; and wherein the second mating element comprises a second pocket connected to the mating surface of the cleaning element which defines a second pocket cavity, and mating the second mating element with the second distal end by inserting the second distal end into the second pocket cavity.

* * * * *